US007439426B2

(12) United States Patent
Meisel

(10) Patent No.: US 7,439,426 B2
(45) **Date of Patent: *Oct. 21, 2008**

(54) ACTUATION SYSTEM FOR KEYBOARD PEDAL LYRE

(76) Inventor: David Meisel, 7271 Kingswood Dr., Bloomfield Township, MI (US) 48301

( * ) Notice: Subject to any disclaimer, the term of this patent is extended or adjusted under 35 U.S.C. 154(b) by 267 days.

This patent is subject to a terminal disclaimer.

(21) Appl. No.: 11/355,033

(22) Filed: Feb. 15, 2006

(65) Prior Publication Data

US 2006/0179997 A1 Aug. 17, 2006

Related U.S. Application Data

(60) Provisional application No. 60/653,038, filed on Feb. 15, 2005.

(51) Int. Cl.
*G10F 1/02* (2006.01)
*G10C 3/26* (2006.01)

(52) U.S. Cl. ..... 84/72; 84/225

(58) Field of Classification Search ..... 84/72, 84/225, 229

See application file for complete search history.

(56) References Cited

U.S. PATENT DOCUMENTS 412,657 A 10/1889 Pain
417,680 A 12/1889 Pain
507,703 A 10/1893 Zimmerman
546,582 A 9/1895 Davis
547,071 A 10/1895 Hedgeland
570,911 A 11/1896 Davis
575,072 A 1/1897 Simpkins
576,342 A 2/1897 Davis
674,904 A 5/1901 Cellerier
681,261 A 8/1901 Powers
730,098 A 6/1903 Davis
739,396 A 9/1903 Davis
778,908 A 1/1905 Shonnard
784,457 A 3/1905 Weber
822,881 A 6/1906 Brown
824,315 A 6/1906 Shonnard
889,685 A 6/1908 Hochman
964,274 A 7/1910 Kelly
1,003,201 A 9/1911 Phillips
1,027,257 A 5/1912 Kruck
1,045,710 A 11/1912 Kruck
1,104,282 A 7/1914 Severy et al.
1,133,370 A 3/1915 Dreher
1,148,719 A 8/1915 Sandell
1,170,750 A 2/1916 Hauss
1,181,486 A 5/1916 Severy et al.
1,183,685 A 5/1916 Sinclair et al.
1,198,070 A 9/1916 Severy et al.

(Continued)

FOREIGN PATENT DOCUMENTS

WO WO-9427279 11/1994

*Primary Examiner*—Jeffrey Donels
(74) *Attorney, Agent, or Firm*—Gifford, Krass, Groh, Sprinkle, Anderson & Citkowski, PC

(57) ABSTRACT

The present invention provides an actuation system for the pedal system of a keyboard instrument. The system includes an actuator with block of ferromagnetic material having a bore, a coil disposed in the bore, and a piston surrounded by the coil, the piston is in mechanical communication with a pedal rod. When the actuator is energized, the piston moves relative to the coil, thereby moving the rod.

19 Claims, 4 Drawing Sheets

U.S. PATENT DOCUMENTS

| | | | | |
|---|---|---|---|---|
| 1,245,518 | A | | 11/1917 | Severy et al. |
| 1,398,469 | A | | 11/1921 | Schwarz et al. |
| 1,494,811 | A | | 5/1924 | Sandell |
| 1,603,871 | A | | 10/1926 | Sandell |
| 1,712,638 | A | | 5/1929 | Stoddard |
| 1,979,633 | A | | 11/1934 | Miessner |
| 2,919,619 | A | | 1/1960 | Munzfeld |
| 3,117,481 | A | | 1/1964 | Cushing |
| 3,126,783 | A | | 3/1964 | Von Gunten |
| 3,160,052 | A | | 12/1964 | Von Gunten |
| 3,186,285 | A | | 6/1965 | Von Gunten |
| 3,405,584 | A | | 10/1968 | Von Gunten |
| 3,634,877 | A | | 1/1972 | Cannon et al. |
| 3,787,603 | A | | 1/1974 | Ghere |
| 4,031,796 | A | | 6/1977 | Wilkes |
| 4,338,847 | A | | 7/1982 | Brennan |
| 4,383,464 | A | | 5/1983 | Brennan |
| 4,592,262 | A | | 6/1986 | Yang et al. |
| 4,873,905 | A | | 10/1989 | Murakami et al. |
| 4,899,631 | A | | 2/1990 | Baker |
| 4,913,026 | A | | 4/1990 | Kaneko et al. |
| 4,970,928 | A | | 11/1990 | Tamaki et al. |
| 5,042,353 | A | | 8/1991 | Stahnke |
| 5,081,893 | A | | 1/1992 | Broadmoore |
| 5,107,262 | A | | 4/1992 | Cadoz et al. |
| 5,107,739 | A | | 4/1992 | Muramatsu et al. |
| 5,131,306 | A | * | 7/1992 | Yamamoto ..... 84/19 |
| 5,210,367 | A | | 5/1993 | Taguchi et al. |
| 5,237,123 | A | | 8/1993 | Miller |
| 5,451,706 | A | | 9/1995 | Yamamoto et al. |
| 5,557,052 | A | | 9/1996 | Hayashida et al. |
| 5,565,635 | A | | 10/1996 | Kaneko et al. |
| 5,612,502 | A | | 3/1997 | Ura et al. |
| 5,648,621 | A | | 7/1997 | Sasaki et al. |
| 5,714,702 | A | | 2/1998 | Ishii et al. |
| 5,739,450 | A | | 4/1998 | Fujiwara et al. |
| 5,796,023 | A | | 8/1998 | Kumano et al. |
| 5,861,566 | A | | 1/1999 | Kaneko et al. |
| 5,874,687 | A | | 2/1999 | Kawamura et al. |
| 5,892,165 | A | | 4/1999 | Oba et al. |
| 5,994,632 | A | | 11/1999 | Muramatsu et al. |
| 6,011,214 | A | | 1/2000 | Kawamura et al. |
| 6,121,535 | A | | 9/2000 | Muramatsu et al. |
| 6,194,643 | B1 | | 2/2001 | Meisel |
| 6,444,885 | B2 | | 9/2002 | Meisel |
| 6,781,046 | B2 | | 8/2004 | Meisel |
| 6,888,052 | B2 | * | 5/2005 | Meisel ..... 84/16 |
| 6,891,092 | B2 | | 5/2005 | Meisel |
| 7,019,201 | B2 | | 3/2006 | Meisel |
| 2005/0235801 | A1 | | 10/2005 | Muramatsu et al. |
| 2006/0021488 | A1 | | 2/2006 | Fujiwara et al. |
| 2006/0112809 | A1 | | 6/2006 | Muramatsu et al. |

* cited by examiner

Figure 3
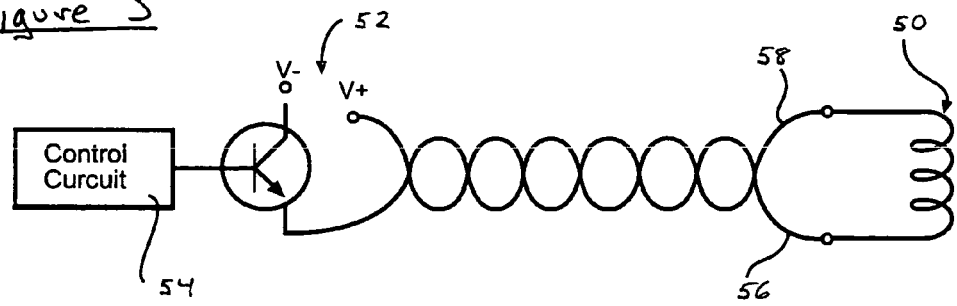
Figure 4
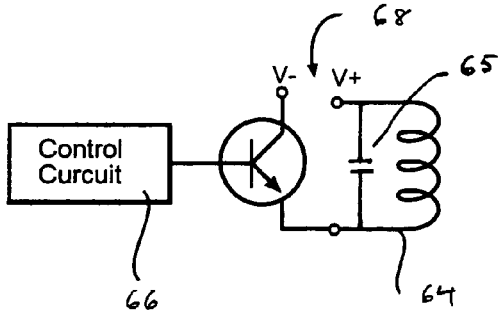
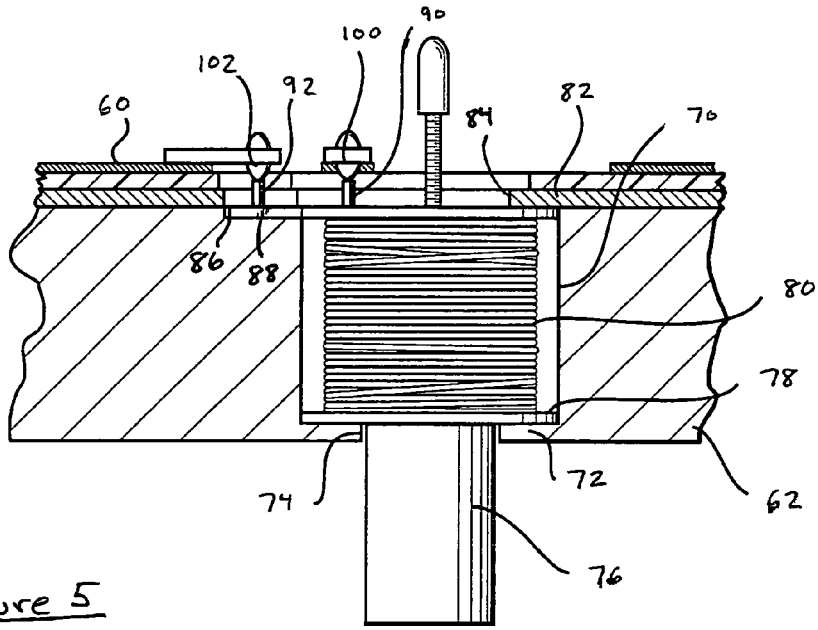
Figure 5

ACTUATION SYSTEM FOR KEYBOARD PEDAL LYRE

REFERENCE TO RELATED APPLICATION

This application claims priority from U.S. Provisional Application Ser. No. 60/653,038, filed Feb. 15, 2005, the entire content of which is incorporated herein by reference.

FIELD OF THE INVENTION

The present invention relates generally to actuation (player) systems for acoustic and electronic keyboards. A better understanding of key actuation systems, as well as the present invention, may be had by reference to Applicant's issued U.S. Pat. Nos. 6,194,643; 6,444,885; 6,781,046; 6,888,052; and 6,891,092, and pending application U.S. Ser. No. 11/106,301, the entire content of all of which are incorporated herein by reference in their entirety.

BACKGROUND OF THE PRESENT INVENTION

Applicant's prior patents and applications had been primarily directed towards the actuation of the keys of a keyboard instrument, which are normally operated by the fingers of a musician. A musician playing the keyboard instrument also operates pedals which alter the way the keyboard instrument operates. For example, one pedal is called a "sustain," and by depressing the pedal, the notes played on the keyboard are sustained for a longer period. Keyboard actuation systems preferably include some means for operating the same system normally operated by the pedals.

SUMMARY OF THE INVENTION

The present invention provides a pedal actuation system for a keyboard instrument that has at least one pedal and a rod interconnecting the pedal with a component to be moved by the pedal. The system includes an actuator with a piston in the mechanical communication with the rod and a coil surrounding the piston. When the actuator is operated, the coil is energized to move the piston relative to the coil, thereby moving the rod.

BRIEF DESCRIPTION OF THE DRAWINGS

FIG. 3 is a diagram of a circuit used in some actuator control systems;

FIG. 4 is a diagram of a circuit which may be used with the present invention;

FIG. 5 is a cross-section of an embodiment of an actuator for use with the present invention;

DETAILED DESCRIPTION OF THE INVENTION

Figure 1:
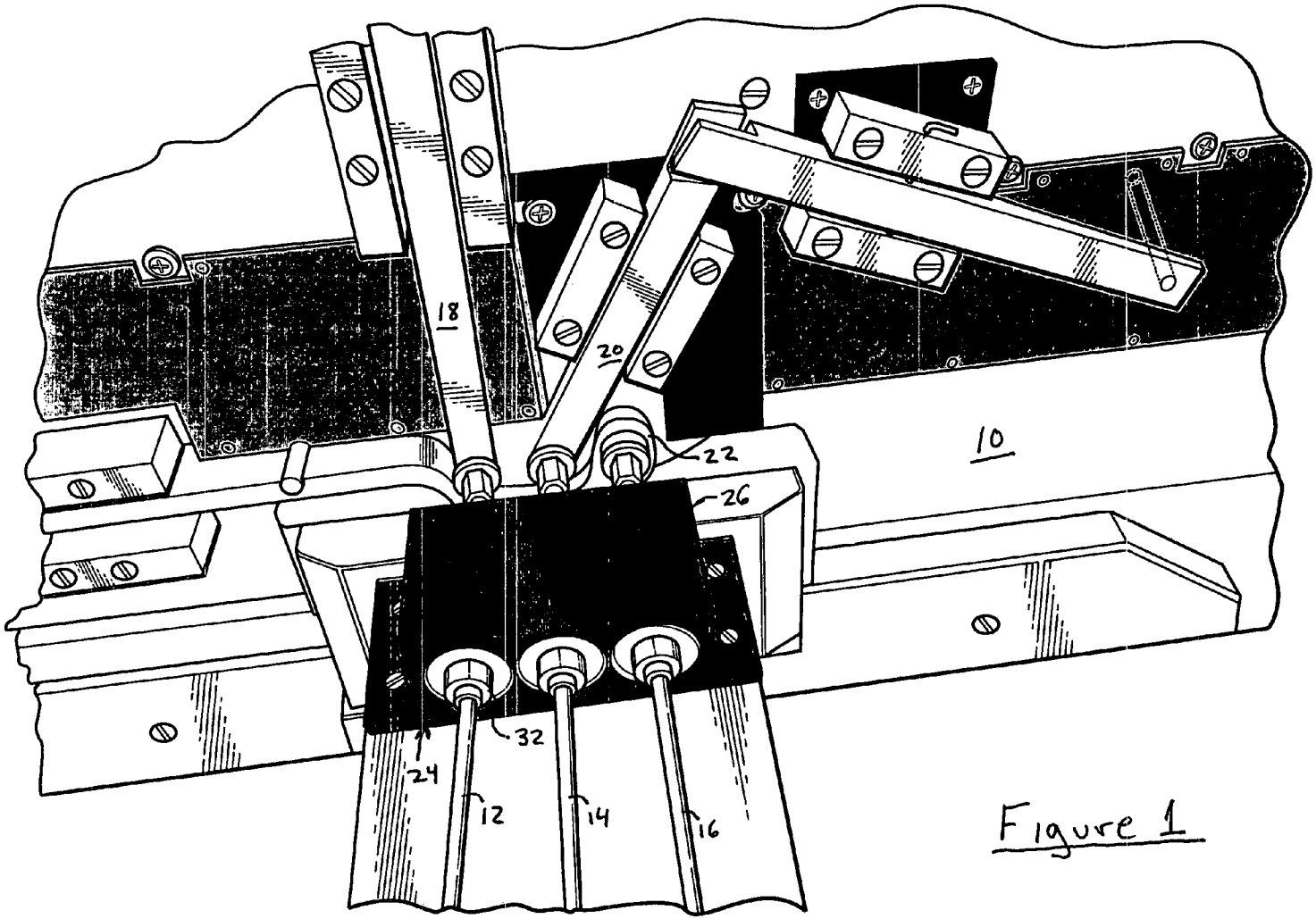
FIG. 1 is a perspective view of the underside of a keyboard instrument showing a pedal actuation system according to an embodiment of the present invention.
Figure 2:
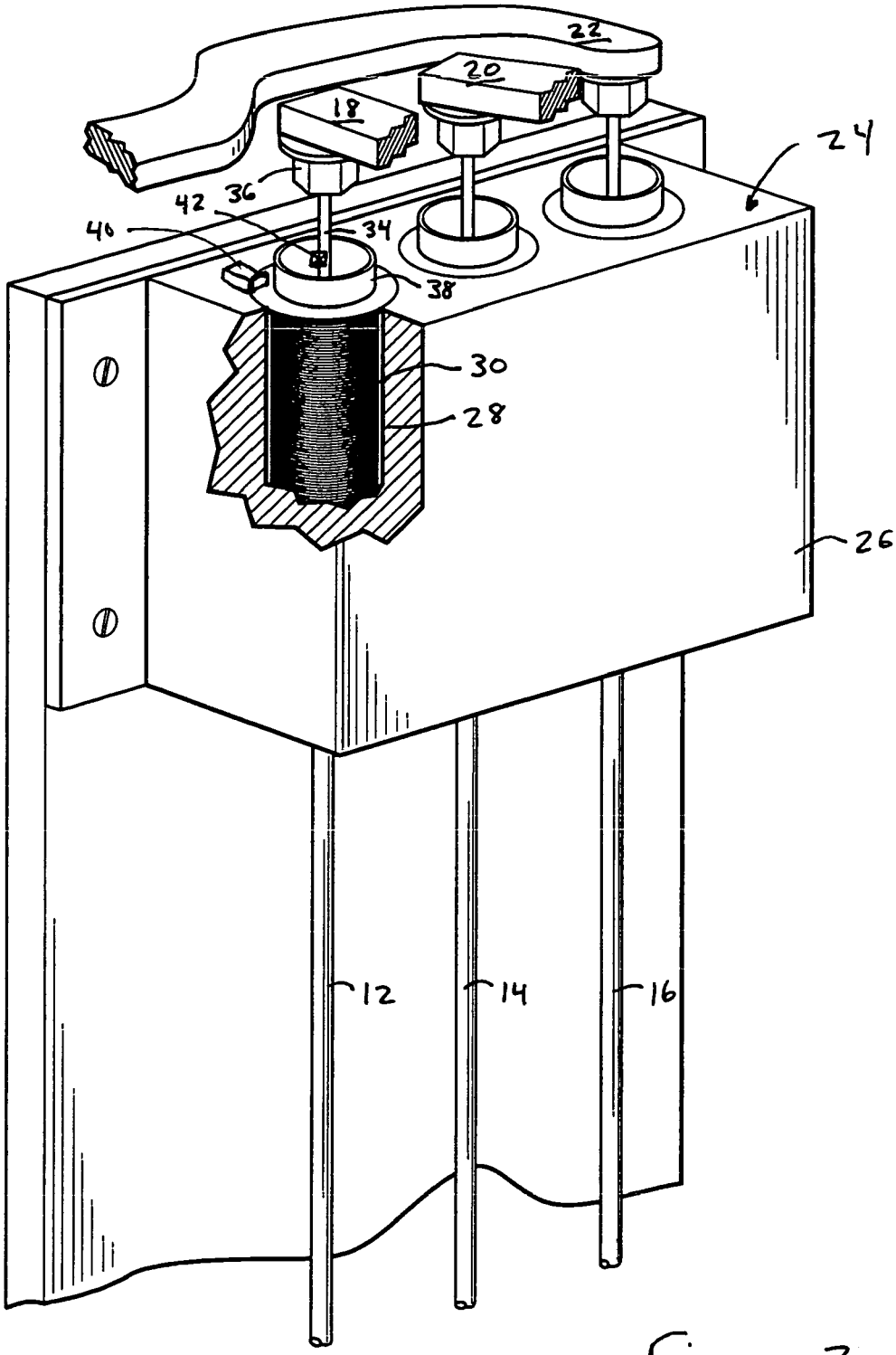
FIG. 2 is a perspective view of a portion of an actuation system according to the present invention with part of the housing cut away.

FIG. 1 shows a view of an actuation system for the pedal lyres according to a preferred embodiment of the present invention. FIG. 1 is a view looking up under the keybed of a keyboard instrument, with the bottom of the key bed shown at 10. In a normal non-player piano, pedals located near the floor may be depressed so as to cause rods 12, 14 and 16 to move upwardly, depending on which pedal is depressed. The rods 12, 14 and 16 have upper ends that contact and actuate lever arms 18, 20 and 22, respectively. According to the present invention, an actuator assembly 24 is disposed such that the rods 12, 14 and 16 pass therethrough and such that the actuator assembly 24 may selectively move any or all of the rods. The actuator assembly 24 has an outer housing 26 with bores defined therethrough coaxial with each of the rods 12, 14 and 16. FIG. 2 shows a view of the assembly 24 with the housing 26 partially cut-away. A first bore 28 is shown with a coil 30 disposed therein. Referring again to FIG. 1, a piston 32 is interconnected with the rod 12 and disposed in a central bore of the coil 30. When the coil is energized, the piston is pulled upwardly into the bore in the coil, thereby moving the rod 12 upwardly.

In a preferred embodiment, the rod 12 is shorter than a standard rod for this application, and is threaded into the bottom of the piston 32. The rods 12, 14 and 16 may be formed of a ferromagnetic material, or of other materials. An upper rod 34 extends from the upper end of the piston 32 and contacts the arm 18. The upper rod 34 is preferably threaded into the piston 32. The upper end of the upper rod 34 preferably has a foot 36 with a pad that contacts the arm 18. The pistons and upper rods for the rods 14 and 16 are preferably constructed similarly.

In the illustrated embodiment, the actuators for actuating the rods are considered pull solenoids, since when the coil 30 is energized, the piston 32 is pulled upwardly into the coil. Alternatively, a push arrangement may be used wherein the piston is pushed out of the coil. Also, springs or other preload or assist devices may be used to modify the operation of the system.

The actuation system for the pedals preferably is controlled as a closed-loop system. As such, it is preferred that some type is sensor is provided for sensing the position of the rod or piston relative to the coil or housing. As will be clear to those of skill in the art, such a sensor may be accomplished in a large number of ways. An exemplary sensor 40 and target 42 are shown in FIG. 2. These may represent sensor systems such as optical reflective, optical beam break, inductive, magnetic, hall effect or others. The sensor and target may be positioned in other areas of the system. The sensor and target may also be directly interconnected with various components, such as the rod 34 and bobbin 38. Position sensing may also be accomplished indirectly, as will be discussed hereinbelow.

According to a further alternative, the actuators may be offset from the rods and have levers or other interconnections for moving the rods. Adaptations of the design shown in Applicant's incorporated patents and application may be modified for this use.

As discussed in Applicant's incorporated patents and application, it is preferred that the housing 26, or a portion of the housing, be formed of a ferromagnetic material with the bores, such as 28, defined therethrough. This body of ferromagnetic material acts as a flux path and improves the performance of the actuators. Preferably, the housing 26 is a solid block of ferromagnetic material with the bores, such as 28, defined therethrough. Alternatively, individual blocks for each actuator may be used, with the blocks preferably arranged to form a larger block. The solenoid block may be formed by machining holes in a piece of barstock. The barstock may be one continuous piece or several shorter pieces may be used. The coil 30 is placed in the bore 28 in the solenoid block 26 to form the outer part of the actuator. In one preferred embodiment, the outer winding 30 is formed by winding wire about a bobbin or spool 38. The bobbin or spool preferably is plastic, such as nylon, and has an inner copper sleeve. The bobbin or spool 38 has a central bore sized to accept the piston 32. The piston 32 is preferably a cylindrical piece of ferromagnetic material sized to be received inside the coil 30 or bobbin 38.

According to the present invention, it is preferred that a driver circuit be provided for driving and controlling the actuators. It is also preferred that the driver circuit for the solenoids be connected as directly as possible to the solenoids themselves. FIG. 3 schematically illustrates the traditional approach to wiring actuators, such as solenoids, to a control circuit. Each actuator includes a coil 5, which is energized in order to move the solenoid's piston. A power supply 52 is shown schematically as "V+" and "V−". A control circuit is shown schematically at 54. The control circuit may take any of several forms, but acts to selectively connect and disconnect the power supply to and from the coils so as to energize and de-energize the coil. Together, the control circuit and the power supply may be considered to form a driver circuit for controlling the actuator. Basically, the control circuit controls whether or not the winding is connected to the source of the power, and therefore controls energizing of the winding. The coil 50 is wound from solid wire and is interconnected with a power supply and the control circuit by electrical leads 56 and 58. These leads 56 and 58 are typically stranded and insulated wires so as to provide flexibility. Depending on the design of the actuator system, the length of the leads 56 and 58 varies. The use of leads 56 and 58 is disadvantageous because it leads to stray capacitance and inductance, and act as RFI and EMI antennae. Use of the flexible leads also reduces the ability of the control circuit to accurately and efficiently control movement of the actuator. Manufacturers generally prefer to use shorter leads to reduce this effect. However, all current keyboard manufacturers have required the use of some length of leads for key actuation systems. The controls circuits are provided on circuit boards that are mounted close to the set of actuators, with the control circuits being interconnected with the individual actuators by means of leads, such as 56 and 58. The flexible leads allow the positions of the actuators to be adjusted somewhat, relative to the control circuits. Some manufacturers recommend twisting the leads of 56 and 58 about each other, as shown, to somewhat reduce the undesirable electrical effects of the leads. However, this approach does not eliminate the problem.

As mentioned above, it is preferred that the solenoid coils are housed in blocks of ferromagnetic material such that the positions of the coils are absolutely set for a particular type or design of piano. Therefore, the coils do not have to be moved or adjusted. A preferred solenoid block design is illustrated in FIG. 5, though it is not to scale. In this preferred approach, a circuit board 60, including the driver circuits for the actuators, is placed directly atop the solenoid block 62 so that the leads are eliminated. This approach is shown schematically in FIG. 4. In this design, the solid coil wire 64 is connected directly to the control circuit 66 and power supply 68, and the flexible leads are entirely eliminated. A capacitor 65 is shown, which is optional and used for position sensing, as will be described below. The direct connection may be achieved via pins that extend into direct connection with the circuit board, or in other ways. This design significantly reduces stray inductance, capacitance, EMI and RF. In addition, the control circuit is much better able to control the position of the piston within the actuator coil, due to the elimination of the leads. Efficiency is also improved. This design approach could be used with individual actuators, though this approach is less preferred than the approach using a solid block housing the individual coils.

Referring again to FIG. 5, the preferred approach to providing a solenoid block with direct interconnection between the control circuits and the solenoid coils will be described in more detail. A block of ferromagnetic material 62 is provided, with a plurality of bores 70 defined therein. Preferably, the bores 70 are closed off or necked down at their lower end, as best shown in FIG. 5 at 72. In the illustrated embodiment, a smaller bore 74 is provided at the lower end 72 to allow a central guide portion 76 of the coil bobbin 78 to extend downwardly beyond the lower end of the block 62. This downwardly extending portion may have a pad therein for the piston to rest on, and may have an opening at the bottom to avoid trapping air. Partially or completely closing off the lower end of the bore 70 improves the flux path for the actuator. The upper end of the bore 70 may be necked down in order to partially close off the upper end of the bore. In one design according to the present invention, washers are press fit into the upper end of each bore, after the bobbin 78 with the coil wire 80, is placed in the bore 70. According to a more preferred approach, the upper end of the bore is partially closed off by a flux plate 82. The flux plate 82 is a thin plate of ferromagnetic material with a plurality of smaller bores 84 defined therein, and positioned so as to be aligned with each of the larger bores 70 in the block 62 when the flux plate 82 is positioned on the block. The use of the flux plate provides for much faster assembly of the solenoid block, than the use of individual washers. The use of the flux plate also reduces the required machining accuracy for the bores, since a "press fit" washer is no longer required. In one embodiment of the present invention, the ferromagnetic block is a block of iron that is sufficiently large that there is substantial ferromagnetic material around all sides of the winding. Preferably, the wall thickness provided by the ferromagnetic block is at least 0.010 to 0.020 inches on all sides of the winding and bobbin and at least 0.0200 inches at the bottom. As shown, the block may be substantially larger, such that the thickness around the various sides of the bores is significantly greater than these minimums. Also, it should be noted that the "effective" thickness of the flux path around the bobbins depends on the average thickness of the walls, rather than the minimum thickness. The thickness of the walls is substantially greater on some sides than on others, due to the shape of the block and the position of other bores. It is also preferred that the distance between adjacent bores be at least 0.030 to 0.040 inches, though it may be substantially greater. The positioning of the bores depends to a large extent on the configuration of the piano into which the actuation system will be placed. While the flux plate is shown as being partially relieved to allow room for contacts, it is preferred that the flux plate partially close off the upper end of the bore. In the embodiment with the above-discussed dimensions, the flux plate openings have a width or diameter of approximately 0.55 to 0.75 inches, not including the area for the contacts. Preferably, the flux plate openings are just slightly larger than the inside diameter of the bobbins, making them slightly larger than the outside diameter of the pistons so the pistons can pass upwardly through the openings at the upper end of their travel. This clearance may be as little as 0.001 inch, but is more typically 0.010 inch on the diameter. The flux plate, in this embodiment has a thickness of approximately 0.0200 inches. Also, for purposes of this invention, a block of ferromagnetic material should be understood to refer to a substantially continuous portion of ferromagnetic material that surrounds bores for two or more actuators. The block may be formed for multiple pieces, but is preferably assembled into an effectively continuous block. For example, one block may be cut with bores that are the same diameter all the way through, while a flux plate is attached to the top and bottom to neck down the bores. The block may also be formed of multiple thinner sheets, with multiple sheets assembled so as to provide bores of various depths with the bore preferably being at least partially closed off at the bottom. According to another alternative, a block housing multiple windings may be formed by individual small blocks or subassemblies, with each subassembly housing only one or a few actuators. For example, if a sub-block is machined with a bore for one winding, and is then combined with multiple other sub-blocks, a block, as defined herein, may be formed. The ferromagnetic block may be formed by casting or other methods. The bores may be machined or may be cast. As a further alternative, if the blocks are formed by multiple sheets that are stacked together, the bores may be punched or laser cut into each sheet.

As shown, the upper end of the bores 70 may each have a relieved side area 86 to receive a tab 88 which extends from the upper end of the bobbin 78. As illustrated, the coil wire 80 preferably terminates, or is connected to, a pair of contact points 90 and 92 that extend upwardly from the upper end of the bobbin 88. The smaller bores 84 in the flux plate 82 are relieved at one side to make room for these upwardly extending contact points 90 and 92. The circuit board or driver board 60 is positioned atop the flux plate 82 and has contact tabs positioned to contact the contact points 90 and 92 for each coil. In FIG. 5, the contact tabs for one of the coils are shown at 100 and 102. These tabs may be spring loaded so as to securely contact the contact points 90 and 92. This design places the driver board 60 in direct contact with a coil wire, and completely eliminates the use of stranded leads. The distance between each control circuit and its associated coils are also minimized. The driver board 60 preferably has driver circuitry defined thereon for controlling the energizing of each coil. These may include control circuits, with other traces routing power from the power supply to the circuits and windings. In one embodiment, the driver board circuitry is produced as integral with the flux plate 82. For example, the ferromagnetic flux plate 82 may have layers of circuitry built up thereon with insulation layers as needed. Traces on the driver board 8 communicate back to a main power supply, such as by leads 8. According to the present invention, it is less critical to minimize the distance between the main power supply and individual coils than it is to minimize the distance between the control circuitry in the coils and to eliminate stranded leads therebetween.

In the previous discussed embodiments of the present invention, actuators have typically been described as having generally cylindrical housings or bores, windings wound about a cylindrical center support, and generally cylindrical pistons. Alternatively, in any of the embodiments discussed herein, the bores and/or the bobbins and/or the pistons may have non-cylindrical shapes. In one example, a ferromagnetic block may have generally square or rectangular bores formed therein with matching rectangular or cylindrical bobbins placed in the bores. The bobbin may also have a rectangular or square central piston bore and the piston may have a rectangular or square cross-section. Such an alternative provides certain advantages in some applications. Other non-cylindrical shapes may also be used, such as oval, octagonal, triangular, or other. Also, shapes may be mixed. For example, a rectangular or square bore may have a rectangular or square bobbin placed therein, with the bobbin having a generally cylindrical or oval piston bore. Alternatively, a generally cylindrical bobbin may have a central square piston bore with the piston having a square cross-section.

Figure 6:
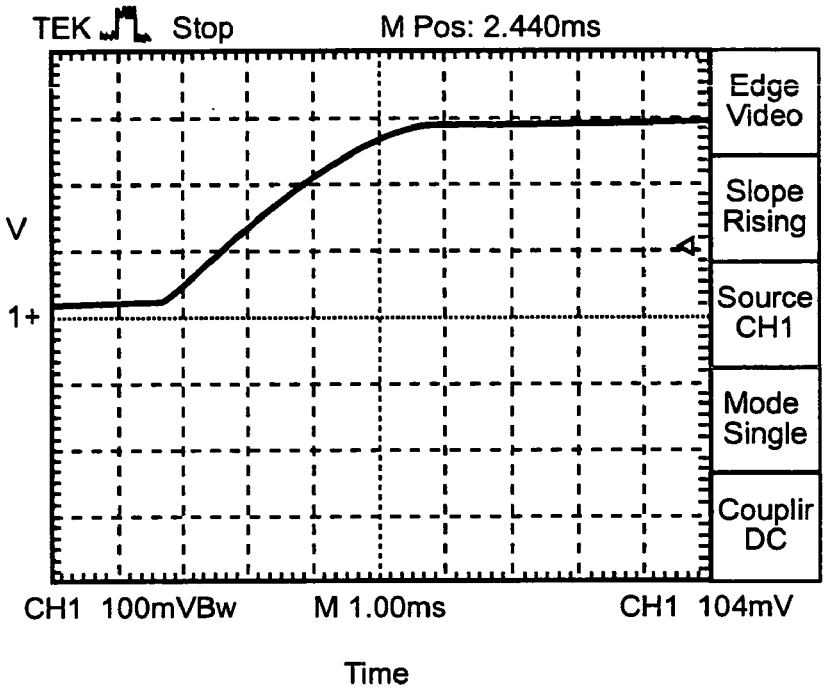
FIG. 6 is a graph showing current rise time for an example of an actuator with a piston in one position.
Figure 7:
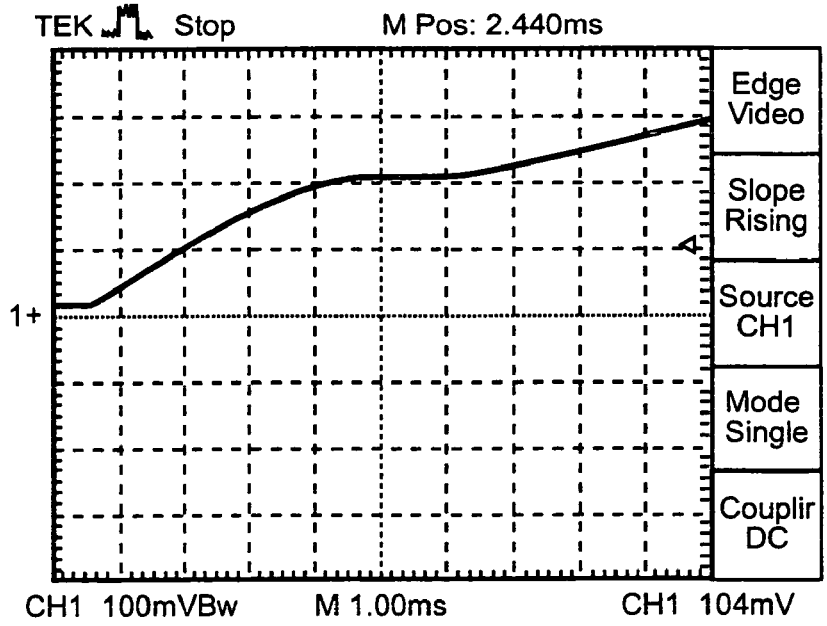
FIG. 7 is a graph similar to FIG. 6 but with the piston in a different position.

According to further aspects of the present invention, piston position may be determined using current draw or rise time or change in reactance. The preferred approach to controlling the power output and position of an actuator is through pulse width modulation (PWM). In this approach, power is provided to the solenoid coil that pulses with the length of each pulse varying depending on the amount of power desired. As mentioned previously, for best control a feedback loop is required so that the solenoid position can be determined. According to a further aspect of the present invention, piston position may be determined based on measurements of current rise time. Each time the power is connected to a solenoid coil, the rate of current rise time by the coil depends on several factors, including the position of the piston within the coil and the temperature of the coil. Therefore, by monitoring the current rise time, the position of the piston in the coil may be determined without the use of an external sensor or other means. Most preferably, the piston position may be determined by monitoring the shape of the current rise time curve. The current rise time curve reflects the change in current draw versus time. FIGS. 6 and 7 are graphs showing current rise time for two positions of an actuator. In FIG. 6, the current rise time curve is shown for an actuator with the piston being in the bottom position. In this position, the piston is mostly or entirely out of the coil. FIG. 7 shows the current rise time for the same actuator with the piston fully inside of the coil. As may be easily seen, the current rise time curves are dramatically different for the two different positions. It should be noted that these particular current rise time curves are not the only curves that may be expected for actuators. Instead, for each design and type of actuator, the current rise time versus position curves may be experimentally determined.

As mentioned previously, the current rise time curve also varies with temperature. Temperature may be determined either by direct sensing, such as by the use of an RTD, or may be modeled. For example, the temperature may be modeled by keeping track of the amount of total energy provided to a particular coil over time. The particular temperature rise in the coil may then be predicted based on theory or on previous experimental results. The temperature of neighboring coils may also be taken into consideration, as heat may be transferred back and forth through the mounts or solenoid block, if a solenoid block is used. This approach to determine piston position eliminates the need for an external sensor and therefore greatly simplifies the design of a closed loop actuator system.

Referring again to FIG. 4, another approach to position sensing will be described. By adding a capacitor 65 in parallel with the coil 64, a "tank" circuit is created. When power is applied to the circuit, a reactance occurs between the pulsed nature of the applied power, the capacitor and the inductance of the solenoid coil. Since the reactance is proportional to the inductance of the solenoid coil, and this inductance changes depending on the position of the piston within the coil, piston position can be determined by monitoring the voltage across the capacitor 65. Other approaches may also be used to determining the position of the piston in the coil. Since inductance of the coil changes with piston position, any approach to sensing inductance, as known to those of skill in the art, may be used to indirectly determine piston position. One exemplary approach is to use an inductance tuned crystal oscillator to determine the inductance of the coil. Inductance based approaches may also be used with a coil that is not the actuator coil. For example, a second sensing coil may be placed below the main actuator coil and be used to sense the position of the piston relative to the second coil.

Those of skill in the art will appreciate that the presently disclosed embodiments may be altered in various ways without departing from the scope or teaching of the present invention.

I claim:

1. A pedal actuation system for a keyboard instrument having at least one pedal and a rod interconnecting the pedal with a component to be moved by the pedal, the system comprising:

an actuator comprising:

a block of ferromagnetic material with a bore defined therein, a winding disposed in the bore, the winding having a hole defined therein, and a piston at least partially disposed in the hole, the piston being in mechanical communication with one of the rods such that movement of the piston causes movement of the rod;

wherein energizing the winding causes the piston to move relative to the winding, thereby moving the rod.

2. The pedal actuation system according to claim 1, wherein the piston is directly connected to the rod and coaxial therewith.

3. The pedal actuation system according to claim 2, wherein the piston is integrally formed with the rod.

4. The pedal actuation system according to claim 2, wherein the rod has a lower portion and an upper portion, the piston being disposed between and interconnecting the lower and upper portions of the rod.

5. The pedal actuation system according to claim 1, wherein the rod has an axis, and the coil is coaxial with the axis.

6. The pedal actuation system according to claim 1, wherein the keyboard instrument has three pedals and three rods, the pedal actuation system further comprising a second and a third actuator each having a piston in mechanical communication with one of the rods and a coil surround the piston.

7. The pedal actuation system according to claim 6, wherein the second and third actuators each further comprise a block of ferromagnetic material with a bore defined therein, the coil being disposed in the bore.

8. The pedal actuation system according to claim 1, wherein the actuator comprises a pull solenoid, the solenoid being operative when the winding is energized to draw the piston into the winding.

9. A pedal actuation system for a keyboard instrument having a plurality of pedals and a plurality of rods each interconnecting one of the pedals with a component to be moved by the pedal, the system comprising:

a plurality of actuators operable to move the rods, the actuators together comprising:

a block of ferromagnetic material with a plurality of bores defined therein, a winding disposed in each of the bores, each of the windings having a hole defined therein, and a piston at least partially disposed in each of the holes, each piston being in mechanical communication with one of the rods such that movement of the piston causes movement of the rod;

wherein energizing one of the windings causes the corresponding piston to move relative to the winding, thereby moving one of the rods.

10. The pedal actuation system according to claim 9, further comprising a ferromagnetic flux plate having a plurality of openings defined therethrough, the flux plate being disposed on a surface of the block of ferromagnetic material with the openings generally aligned with the bores, the openings each having a width that is less than the diameter of the bores such that the flux plate partially closes off the upper end of each bore.

11. The pedal actuation system according to claim 9, wherein each of the windings comprises a wire having a pair of ends, the actuation system further comprising a control circuit operable to interconnect one of the ends of the wire to a source of power for energizing the winding, one of the ends of the wire being directly interconnected with the control circuit without using a flexible lead and the other end being directly interconnected to the source of power without using a flexible lead.

12. The pedal actuation system according to claim 9, wherein each of the actuators comprises a pull solenoid, each solenoid being operative when the winding is energized to draw the piston into the winding.

13. The pedal actuation system according to claim 9, wherein each piston is directly connected to one of the rods and coaxial therewith.

14. The pedal actuation system according to claim 13, wherein each rod has a lower portion and an upper portion, each piston being disposed between and interconnecting the lower and upper portions of one of the rods.

15. The pedal actuation system according to claim 9, wherein each rod has an axis, and each coil is coaxial with one of the axes.

16. A pedal actuation system for a keyboard instrument having a plurality of pedals and a plurality of rods each interconnecting one of the pedals with a component to be moved by the pedal, the system comprising:

a plurality of actuators each operable to move one of rods, each actuator comprising:

a housing;

a winding support disposed in the housing, the winding support having a piston bore defined therein;

a winding disposed on the winding support, the winding comprising a wire wound about the piston bore, the wire having a pair of ends; and a piston at least partially disposed in the piston bore, the piston being in mechanical communication with one of the rods such that movement of the piston causes movement of the rod;

wherein energizing the winding causes the piston to move relative to the winding, thereby moving one of the rods;

a plurality of driver circuits, each driver circuit being operable to selectively energize one of the windings, the driver circuits comprising:

a circuit board disposed adjacent the actuators, the circuit board having one or more of the driver circuits defined thereon, each driver circuit being directly connected to the ends of one of the windings without being interconnected by a stranded wire.

17. A key actuation system according to claim 16, further comprising a block of ferromagnetic material having a plurality of bores defined therein, the block of ferromagnetic material defining the housing for each of the plurality of actuators.

18. The key actuation system according to claim 16, further comprising a ferromagnetic flux plate having a plurality of openings defined therethrough, the flux plate being disposed on the block of ferromagnetic material such that the openings are generally aligned with the bores, the openings in the flux plate being smaller than the bores.

19. The pedal actuation system according to claim 16, wherein each piston is directly connected to one of the rods and coaxial therewith.

* * * * *